US009901779B2

(12) United States Patent
Suzuki

(10) Patent No.: US 9,901,779 B2
(45) Date of Patent: Feb. 27, 2018

(54) CONTROL APPARATUS AND METHOD FOR EXERCISE THERAPY DEVICE

(71) Applicant: Mitsubishi Electric Engineering Company, Limited, Tokyo (JP)

(72) Inventor: Hironori Suzuki, Tokyo (JP)

(73) Assignee: Mitsubishi Electric Engineering Company, Limited, Tokyo (JP)

( * ) Notice: Subject to any disclaimer, the term of this patent is extended or adjusted under 35 U.S.C. 154(b) by 0 days.

(21) Appl. No.: 14/473,352

(22) Filed: Aug. 29, 2014

(65) Prior Publication Data

US 2015/0258384 A1 Sep. 17, 2015

(30) Foreign Application Priority Data

Mar. 12, 2014 (JP) ..... 2014-048568

(51) Int. Cl.

*A63B 24/00* (2006.01)
*A63B 22/06* (2006.01)
*A63B 21/002* (2006.01)
*A63B 21/005* (2006.01)

(Continued)

(52) U.S. Cl.

CPC ..... *A63B 24/0087* (2013.01); *A63B 21/002* (2013.01); *A63B 21/0058* (2013.01); *A63B 22/0605* (2013.01); *A63B 23/0476* (2013.01); *A63B 2024/0065* (2013.01); *A63B 2024/0093* (2013.01); *A63B 2071/065* (2013.01); *A63B 2220/16* (2013.01); *A63B 2220/34* (2013.01); *A63B 2230/62* (2013.01)

(58) Field of Classification Search

CPC ..... A63B 24/0087; A63B 21/0058; A63B 2024/0093; A63B 2225/50; A63B 24/0062; A63B 2225/20; A63B 22/0605; A63B 2220/30; A63B 23/03525; A63B 21/005; A63B 2024/009; A63B 2220/17; A63B 21/00076

USPC ..... 482/1, 5, 8–9

See application file for complete search history.

(56) References Cited

U.S. PATENT DOCUMENTS 5,256,115 A * 10/1993 Scholder ..... A63B 21/0053 482/4
5,331,851 A * 7/1994 Parviainen ..... A61B 5/0488 482/133

(Continued)

FOREIGN PATENT DOCUMENTS

JP 3114274 11/1991
JP 10119874 A * 5/1998
JP 2007-267818 10/2007

*Primary Examiner* — Andrew S Lo

(74) *Attorney, Agent, or Firm* — Price Heneveld LLP

(57) ABSTRACT

Provided is a control apparatus for an exercise therapy device to be used to carry out interval training where a high-intensity exercise and a low-intensity exercise, which have different exercise loads, are alternately carried out, including: an exercise load setting part for inputting an exercise load and exercise time period for the high-intensity exercise and low-intensity exercise from an input device of the exercise therapy device and setting the input exercise load and exercise time period in a storage part of the exercise therapy device as an exercise program; and a display control part for displaying a timing at which an exercise intensity of the exercise program is to change next during the interval training on a display device of the exercise therapy device.

7 Claims, 7 Drawing Sheets

(51) Int. Cl.
*A63B 23/04* (2006.01)
*A63B 71/06* (2006.01)

(56) References Cited

U.S. PATENT DOCUMENTS

| | | | | | |
|---|---|---|---|---|---|
| 5,591,104 | A * | 1/1997 | Andrus | A61B 5/6887 | 434/247 |
| 6,997,852 | B2 * | 2/2006 | Watterson | A63B 21/005 | 482/1 |
| 8,029,415 | B2 * | 10/2011 | Ashby | G06F 19/3481 | 482/49 |
| 2006/0004265 | A1 * | 1/2006 | Pulkkinen | A61B 5/0205 | 600/300 |
| 2007/0249467 | A1 * | 10/2007 | Hong | A63B 22/00 | 482/1 |
| 2007/0287596 | A1 * | 12/2007 | Case, Jr. | A63B 24/00 | 482/8 |
| 2009/0048070 | A1 * | 2/2009 | Vincent | A63B 24/0021 | 482/8 |
| 2009/0298028 | A1 * | 12/2009 | Saunders | G09B 19/003 | 434/258 |
| 2010/0216601 | A1 * | 8/2010 | Saalasti | A61B 5/024 | 482/8 |
| 2013/0178337 | A1 * | 7/2013 | Brammer | A63B 71/0622 | 482/9 |
| 2013/0274069 | A1 * | 10/2013 | Watterson | A63B 24/0087 | 482/9 |
| 2014/0194248 | A1 * | 7/2014 | Kolman | A63B 71/0622 | 482/4 |

* cited by examiner

CONTROL APPARATUS AND METHOD FOR EXERCISE THERAPY DEVICE

BACKGROUND OF THE INVENTION

1. Field of the Invention

The present invention relates to an exercise therapy device such as an ergometer and a treadmill, and more particularly, to a control apparatus and method for an exercise therapy device capable of controlling interval training so that a high-intensity exercise is an anaerobic exercise and a low-intensity exercise is an aerobic exercise.

2. Description of the Related Art

Hitherto, as interval training, which is commonly carried out as training for an athlete such as a track and field athlete, there is employed a method in which an exerciser alternately and repeatedly carries out a plurality of sets of an exercise to be carried out at a high intensity (hereinafter referred to as "high-intensity exercise") and an exercise to be carried out at a low intensity (hereinafter referred to as "low-intensity exercise") (see, for example, Japanese Patent Application Laid-open Nos. 2012-161700, 2007-522862, and Hei 2-14056). The interval training is regarded as enabling an exerciser to enhance, for example, his/her instantaneous power and top speed. In particular, when the high-intensity exercise is an anaerobic exercise, a muscle-strengthening effect can be expected.

However, such a related-art support device for interval training is mainly aimed at prompting an exerciser to follow a target heart rate, which is set depending on an exercise load. In addition, the related-art support device for interval training has only functions of, for example, measuring vital signals such as the exerciser's actual heart rate and notifying the exerciser with sound when the measured heart rate deviates from the target heart rate, and displaying information for distinguishing whether the exercise load is an overload, an appropriate load, or a light load.

Meanwhile, in a field of cardiac rehabilitation for patients with cardiac disease, training with an aerobic exercise that uses an exercise therapy device such as an ergometer and a treadmill is commonly carried out. This is because studies have verified that the life prognosis of the patient with cardiac disease is extended by carrying out an exercise therapy with the aerobic exercise (see, for example, Brandi J. Witt et al., "Cardiac Rehabilitation after Myocardial Infarction in the Community"; Journal of the American College of Cardiology Vol. 44, No. 5, 2004, Elsevier Inc., Sep. 1, 2004, pp. 988-996).

However, among those related-art exercise therapy devices such as an ergometer and a treadmill, there has been no exercise therapy device that is manufactured on the assumption that the exerciser carries out the interval training with the manufactured exercise therapy device. For example, with Japanese Patent Application Laid-open No. 2012-161700, even when an exercise program in which the high-intensity exercise and the low-intensity exercise are alternately repeated can be created, the exercise load of the created exercise program is premised on a heart rate response that is supposed to be reached. In other words, the related-art exercise therapy device is also premised on the heart rate response, as in the related-art support device for interval training.

However, the related arts have the following problems.

According to the New York Heart Association (NYHA) Functional Classification, although depending on the exercise load, a time constant $\tau$ for the response of a heart rate is, at a load of 20 W, about 20 seconds to 40 seconds in a case of a healthy person, and about 55 seconds to 100 seconds in a case of a patient with Class III whose severity of heart failure is high. Accordingly, for a practical purpose, an exercise time period of this response time constant $\tau$ or longer needs to be set as the exercise time period for one exercise load. An operating time period is thus set to $\tau$ or longer in contents of the interval training such as the ones disclosed in Japanese Patent Application Laid-open No. 2012-161700, and hence this interval training does not involve the exercise load for the anaerobic exercise but involves an area for the aerobic exercise in its entire contents.

In addition, a general exercise therapy device includes a display part, which displays numerical values or a graph, as its component so that the exerciser can acquire information on the exercise load. However, the value displayed on the display part has been a value obtained by sampling or averaging the values at regular time intervals, which is designed for each exercise therapy device. Accordingly, although a difficulty in seeing the value due to a dispersion of values is lessened, the peak value within the fluctuation cannot be seen when a load intensity fluctuates within the regular time interval.

As described above, in the related-art exercise therapy device, only the aerobic exercise area is a target of training even when the interval training is carried out. Accordingly, even when the exercise program is created so that the high-intensity exercise is the anaerobic exercise and the low-intensity exercise is the aerobic exercise or a rest state, there have been actually no control apparatus and method for an exercise therapy device capable of appropriately controlling the interval training in order to execute the created exercise program.

As a result, when the exercise therapy device using the heart rate response suited to the aerobic exercise is used to create an exercise program for carrying out the anaerobic exercise, the exerciser becomes short of breath before his/her heart rate rises, and hence control of the exerciser with the heart rate cannot be performed, which is a problem of the related arts. Further, in contrast, even when the anaerobic exercise is to be carried out independently of the heart rate response, a method of accurately carrying out an exercise for an allowable exercise time period that has been prescribed cannot be specified. The time period for the anaerobic exercise thus varies, and hence it is uncertain whether or not an expected effect of the exercise therapy can be obtained, which is another problem of the related arts.

As described above, in the interval training, it is important to execute an allowable anaerobic exercise as accurately as possible. As a method of determining the exercise load for the anaerobic exercise, there is given an exercise prescription in which a one-repetition maximum (1 RM), which is the maximum muscular strength that can be exerted only once, is used as a reference, and a load corresponding to 80% of the 1 RM is prescribed as the exercise load. In order to execute this method, a peak within one rotation needs to be set and displayed when the exercise load is set and the state of the exercise load is displayed in the exercise therapy device. However, with the exercise therapy device which displays only the averaged value, the anaerobic exercise using the 1 RM as the reference cannot be carried out accurately, which is still another problem of the related arts.

SUMMARY OF THE INVENTION

The present invention has been made in order to solve the above-mentioned problems, and has an object to provide a control apparatus and method for an exercise therapy device capable of controlling interval training so that a high-intensity exercise is an anaerobic exercise and a low-intensity exercise is an aerobic exercise, and enabling an exerciser to carry out training with an exercise load suited to his/her purpose while checking a next change of the exercise load.

According to one embodiment of the present invention, there is provided a control apparatus for an exercise therapy device, the exercise therapy device being used to carry out interval training in which a high-intensity exercise and a low-intensity exercise, which have different exercise loads, are alternately carried out, the control apparatus including: an exercise load setting part for inputting an exercise load and exercise time period for the high-intensity exercise and low-intensity exercise from an input device of the exercise therapy device and setting the input exercise load and exercise time period in a storage part of the exercise therapy device as an exercise program; and a display control part for displaying a timing at which an exercise intensity of the exercise program is to change next during the interval training on a display device of the exercise therapy device so that an exerciser is capable of carrying out training with the exercise load suited to a purpose while checking a next change of the exercise load.

Further, according to one embodiment of the present invention, there is provided a control method for an exercise therapy device, the exercise therapy device being used to carry out interval training in which a high-intensity exercise and a low-intensity exercise, which have different exercise loads, are alternately carried out, the control method including: inputting an exercise load and exercise time period for the high-intensity exercise and low-intensity exercise from an input device of the exercise therapy device and setting the input exercise load and exercise time period in a storage part of the exercise therapy device as an exercise program; and displaying a timing at which an exercise intensity of the exercise program is to change next during the interval training on a display device of the exercise therapy device so that an exerciser is capable of carrying out training with the exercise load suited to a purpose while checking a next change of the exercise load.

According to one embodiment of the present invention, the exercise therapy device, which is to be used to carry out the interval training in which the high-intensity exercise and the low-intensity exercise are alternately carried out, is configured to set the exercise load and exercise time period for the high-intensity exercise and low-intensity exercise as the exercise program and display the temporal change of the exercise program on the display device of the exercise therapy device during the interval training. As a result, it is possible to provide the control apparatus and method for an exercise therapy device capable of controlling the interval training so that the high-intensity exercise is the anaerobic exercise and the low-intensity exercise is the aerobic exercise, and enabling the exerciser to carry out training with the exercise load suited to his/her purpose while checking the next change of the exercise load.

DETAILED DESCRIPTION OF THE PREFERRED EMBODIMENTS

Figure 1:
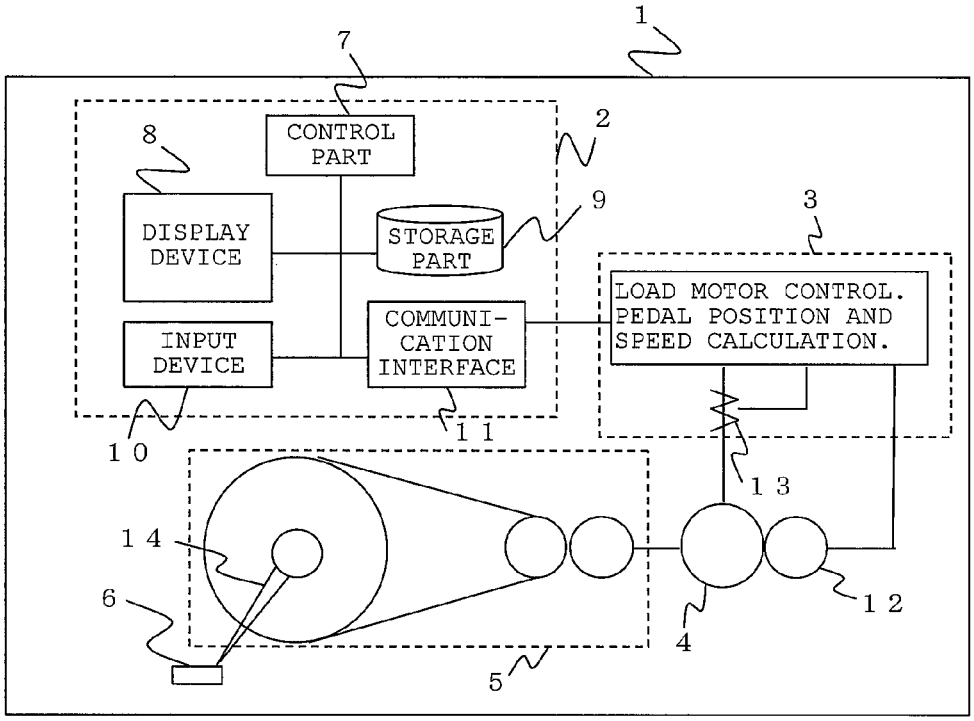
FIG. 1 is a diagram illustrating an example of a configuration of an exercise therapy device according to a first embodiment of the present invention.

Now, a description is given of a control apparatus and method for an exercise therapy device according to an exemplary embodiment of the present invention with reference to the accompanying drawings. Note that, throughout the drawings, like or corresponding components are denoted by like reference numerals to describe those components.

First Embodiment

FIG. 1 illustrates an example of a configuration of an exercise therapy device according to a first embodiment of the present invention. An exercise therapy device 1 illustrated in FIG. 1 enables an exerciser to carry out interval training in which a high-intensity exercise and a low-intensity exercise are alternately carried out.

The exercise therapy device 1 includes a man-machine interface unit 2 for selecting and setting contents of an exercise and displaying a state of the exercise and the like, a load control unit 3 for controlling an exercise load to be applied to the exerciser, a load motor 4 to be controlled by the load control unit 3 to generate the exercise load, a speed reduction mechanism 5 for transmitting the exercise load generated by the load motor 4 to the feet of the exerciser as an appropriate load torque and rotation speed, pedal mounting shafts 14 mounted to the speed reduction mechanism 5 and coupled so as to be freely rotatable, and pedals 6 coupled to the pedal mounting shafts 14 so as to be freely rotatable and used by the exerciser to carry out the exercise by placing his/her feet thereon.

Note that, the right-foot and left-foot pedal mounting shafts 14 and pedals 6 are arranged so as to be perpendicular and face opposite directions with respect to a rotation axis of the pedal mounting shaft 14 so that the exercise loads are applied to both feet of the exerciser.

The man-machine interface unit 2 illustrated in FIG. 1 includes a control part 7, a display device 8, a storage part 9, an input device 10, and a communication interface 11.

The control part 7 controls the load control unit 3 via the communication interface 11 in accordance with set values of the exercise load and exercise time period (or the number of pedal rotations) for the high-intensity exercise and low-intensity exercise of the interval training (hereinafter referred to as "exercise program") stored in the storage part 9. Further, an exercise load setting part (not shown) of the control part 7 inputs the exercise program from the input device 10 and stores the input exercise program in the storage part 9. Further, a display control part (not shown) of the control part 7 graphically displays the exercise program stored in the storage part 9 on the display device 8, and displays information on the rotational position and rotation speed of the pedal 6 input thereto from the load control unit 3, which is described later, on the display device 8.

The load control unit 3 illustrated in FIG. 1 controls the load motor 4 in accordance with a target exercise load value, which is output from the man-machine interface unit 2. Further, the load control unit 3 calculates the rotational position and rotation speed of the pedal 6 based on measured values of the rotational position and rotation speed of a rotation axis of the load motor 4, which are output from a position/speed detector 12 mounted to the load motor 4, and outputs the calculated rotational position and rotation speed to the man-machine interface unit 2.

Figure 2:
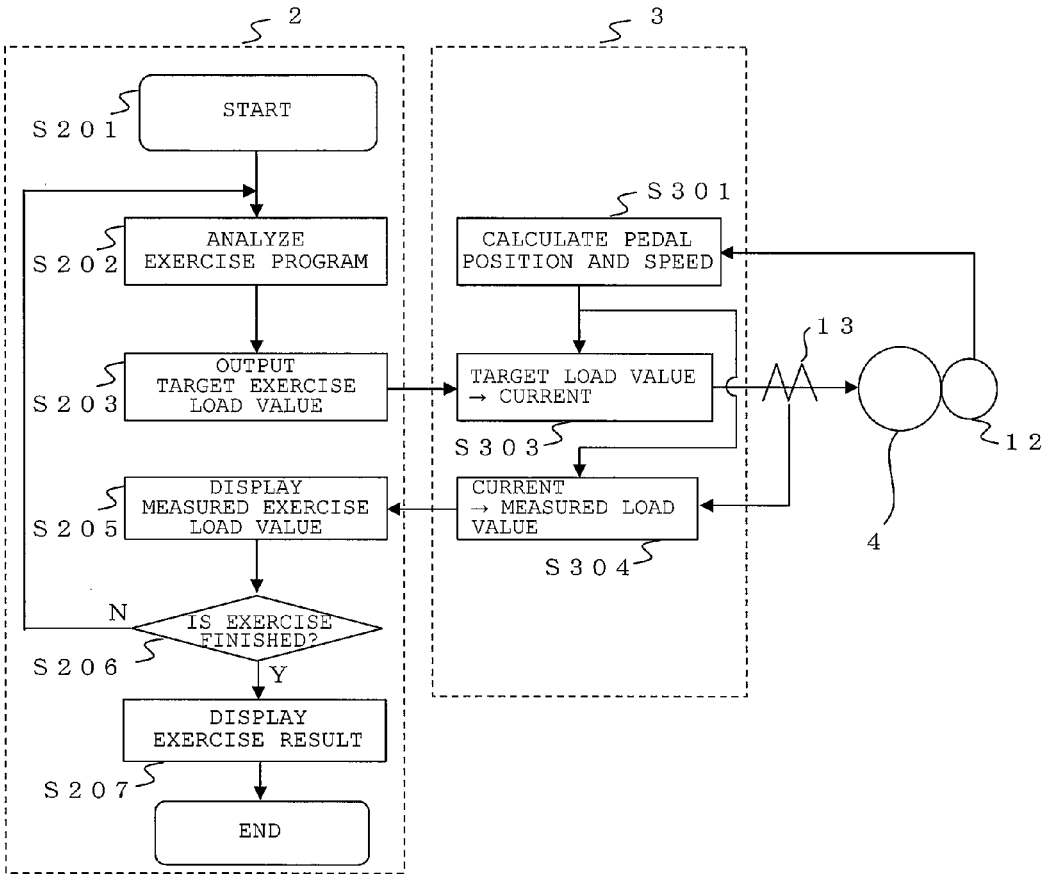
FIG. 2 is a flow chart illustrating a control method for an exercise therapy device according to the first embodiment of the present invention.

FIG. 2 is a flow chart illustrating a control method for the exercise therapy device 1 according to the first embodiment of the present invention.

In Step S201, the control part 7 of the man-machine interface unit 2 starts control of the interval training. Next, in Step S202, the control part 7 reads the exercise program from the storage part 9 and analyzes the read exercise program. Then, in Step S203, the control part 7 calculates the target exercise load value of the load motor 4 based on the exercise program, and outputs the calculated target exercise load value to the load control unit 3 via the communication interface 11.

In Step S301, the load control unit 3 calculates the rotational position and rotation speed of the pedal 6 based on the measured values of the rotational position and rotation speed of the rotation axis of the load motor 4, which are output from the position/speed detector 12 mounted to the load motor 4, and information on a gear ratio of the speed reduction mechanism 5. Then, in Step S303, the load control unit 3 controls a motor current applied to the load motor 4 based on the target exercise load value output from the man-machine interface unit 2 and information on the rotational position and rotation speed of the pedal 6 to generate a load torque corresponding to the motor current. In this manner, the load control unit 3 controls the exercise load to be applied to the pedal 6 and rotation speed thereof.

Then, in Step S304, based on a current value of the load motor 4, which is output from a current detector 13 mounted to the load motor 4, and the information on the rotational position and rotation speed of the pedal 6, the load control unit 3 converts a unit of the exercise load from torque to Watts, which is easily recognizable for the exerciser. Then, the load control unit 3 outputs a result of this unit conversion to the man-machine interface unit 2.

In Step S205, the control part 7 of the man-machine interface unit 2 displays the measured value of the exercise load, which is input thereto from the load control unit 3, on the display device 8 in order to enable the exerciser to recognize the measured value.

In Step S206, the control part 7 of the man-machine interface unit 2 repeats the above-mentioned operation until the interval training is finished. Then, when the interval training is finished, in Step S207, the control part 7 displays a result of the interval training on the display device 8.

Figure 3:
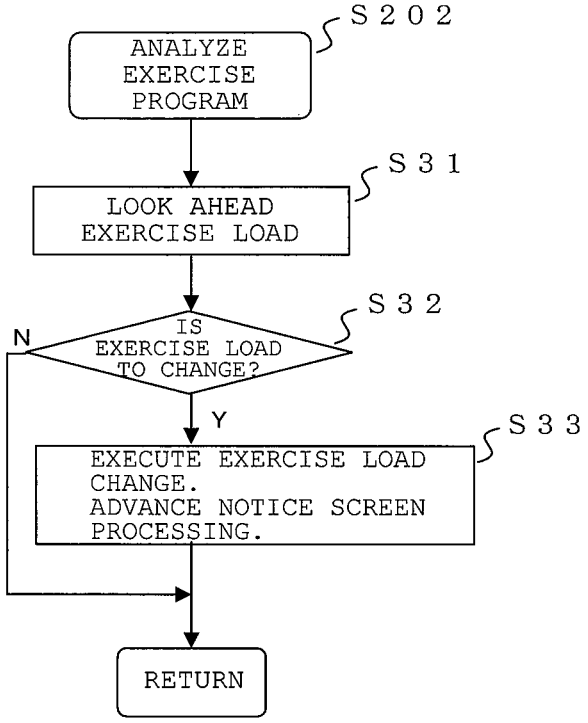
FIG. 3 is a flow chart illustrating Step S202 of the flow chart of FIG. 2 in detail.

FIG. 3 is a flow chart illustrating Step S202 of the flow chart of FIG. 2 in detail. When the analysis of the exercise program is started in Step S202, in Step S31, the control part 7 looks ahead the exercise load in accordance with a descriptive content of the exercise program, and in Step S32, determines whether or not the exercise load is to change. Note that, in this step, how far the control part 7 looks ahead the exercise load is determined based on a time unit set depending on a description method for the exercise program and how early an advance notice screen to be described later is to be displayed. When it is determined that the exercise load is to change in Step S32, in Step S33, the control part 7 executes processing for the advance notice screen for indicating the change of the exercise load. On the other hand, when it is determined that the exercise load is not to change in Step S32, the control part 7 finishes the analysis of the exercise program.

Figure 4:
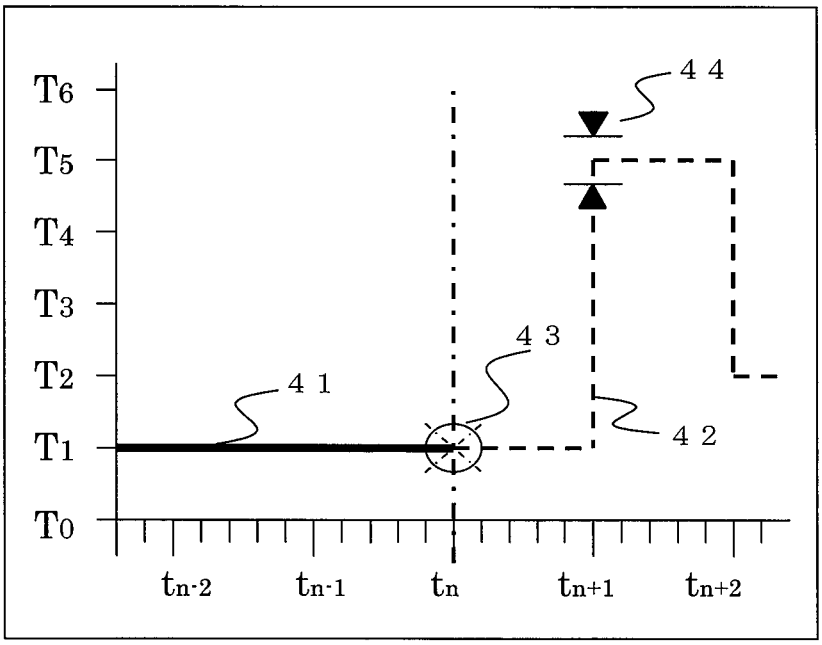
FIG. 4 illustrates an example of a temporal change of an exercise program, which is displayed on a display device of the exercise therapy device according to the first embodiment of the present invention.

FIG. 4 illustrates an example of a temporal change of the exercise program, which is displayed on the display device 8 of the exercise therapy device 1 according to the first embodiment of the present invention. FIG. 4 illustrates an example of what is displayed on the display device 8 in Step S33 of FIG. 3.

If the control part 7 does not look ahead the exercise load in Step S31 and thus a scheduled exercise load change time 42 and an exercise load change marker 44 are not displayed on the display device 8, the exerciser can recognize a change of the exercise load only after the exercise program proceeds to the next exercise load, and hence the exerciser can only carry out the exercise at a delayed time at any time. In particular, in such interval training that a load for the high-intensity exercise is one for the anaerobic exercise, a time interval during which the load for the high-intensity exercise is applied is a period of time that corresponds to a breath during which the exerciser can hold his/her breath, and hence this time interval is about 5 seconds to 10 seconds in normal cases, and about 30 seconds at a maximum. Accordingly, even one or two seconds of a time delay occupies a large ratio of this time interval.

In particular, when a load control for an isokinetic contraction exercise is performed, the load control involves applying an exercise load that balances a muscular strength exerted by the exerciser at his/her discretion. A load as prescribed in an exercise prescription is thus changed by an amount corresponding to a delayed time, and hence an influence on the exercise effect is great.

In view of this, in the first embodiment, on the display device 8 of the exercise therapy device 1, the exercise load proceeding along with a temporal change is drawn in a graph screen having a time axis as an abscissa axis and an exercise load axis as an ordinate axis so that the center of the time axis is a current time tn. A portion of the locus of the graph that is on the left side of the current time tn, which corresponds to times tn−1 and tn−2, is an exercise-finished portion 41, and this portion is drawn with a thick solid line.

Further, a portion of the locus that is on the right side of the current time tn, which corresponds to times tn+1 and tn+2, indicates the exercise load to be applied when the time proceeds from now, and how the exercise load is switched at the scheduled exercise load change time 42, which is analyzed in advance, is drawn with a thin broken line by looking ahead the exercise program. Moreover, a current time marker 43 and the exercise load change marker 44 are drawn on this graph as a scheme for enabling the exerciser to further recognize a change of the exercise load.

With this, the exerciser can more surely recognize that the exercise load of a T1 level at the current time to is to be changed to the exercise load of a T5 level at the time tn+1. The exerciser can therefore be prepared to carry out the exercise at a high intensity at just the time tn+1 while following the progress of the solid line portion of the graph.

Figure 5:
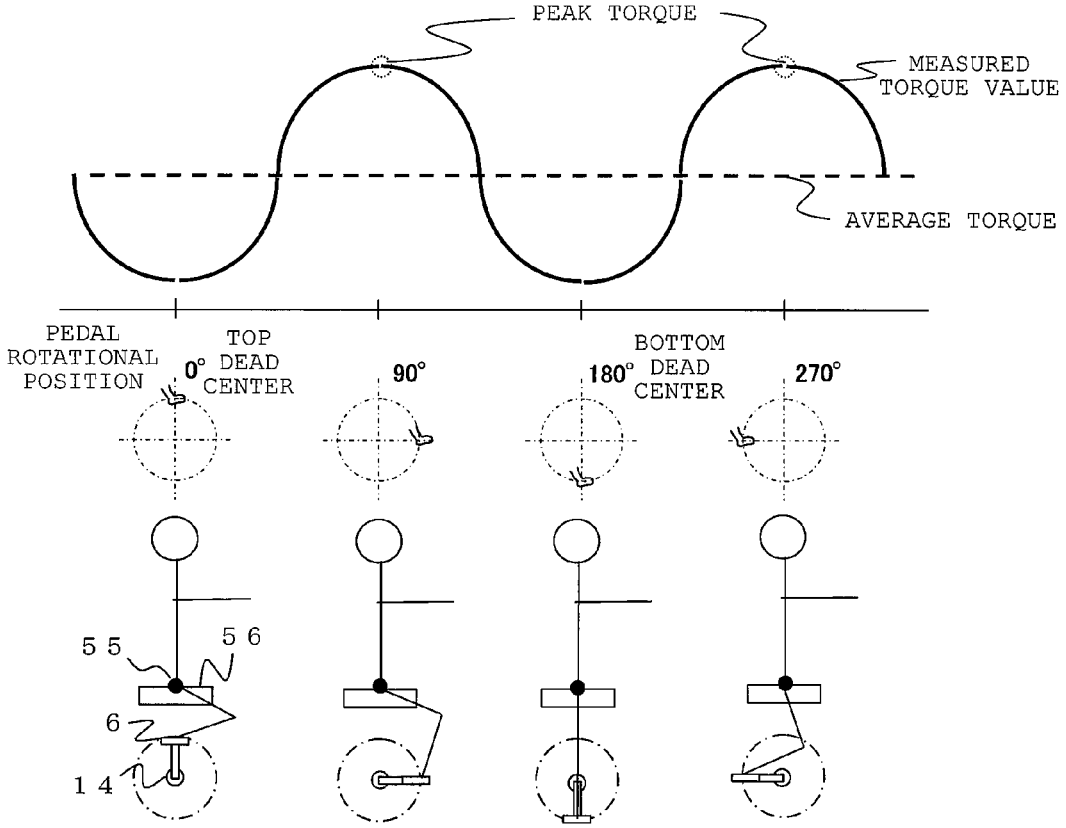
FIG. 5 is a diagram illustrating a relationship between a rotational position of a pedal and a rotation torque applied to the pedal in the exerciser's pedaling operation.

FIG. 5 is a diagram illustrating a relationship between the rotational position of the pedal 6 and a rotation torque applied to the pedal 6 in the exerciser's pedaling operation. A lower part of FIG. 5 illustrates an example of the pedal rotational position obtained when the exerciser is seated on a seating part 56 arranged above the center of the pedal mounting shaft 14, and such a position that a distance between a greater trochanter 55 of the exerciser's pelvis and the position of the pedal 6 is closest is indicated as 0°, and such a position that the distance is farthest is indicated as 180°.

As illustrated in FIG. 5, when the position of one of the exerciser's feet is a top dead center (0°) or a bottom dead center (180°), even the maximum force with which the exerciser steps on the pedal in a vertical direction generates no component of force in a tangential direction of the pedal 6, and hence the rotation torque exerted by the exerciser is approximately zero. On the other hand, when the position of one of the exerciser's feet is in the vicinity of 90° or in the vicinity of 270°, the rotation torque exerted by the exerciser is the maximum, that is, a peak torque.

To be exact, the angle and shape of the waveform vary depending on the exerciser's ankle joints, the angle of the pedal 6, and how the exerciser operates the pedal 6. However, in any case, the rotation torque never transitions at a constant level independently of the angle of the pedal 6, and has a waveform that has the peak torque of the measured torque value and fluctuates with the level of an average torque as its center. As can be understood from this waveform, the maximum muscular strength is not the value of the average torque but the value of the peak torque, which is obtained when the angle of the pedal 6 is in the vicinity of 90° or 270°.

The peak torque is more appropriate than the average torque as a torque to be compared with a one-repetition maximum (1 RM), which is the maximum muscular strength. On the other hand, the average torque is more appropriate than the peak torque as an actual value of an exercise load torque. In other words, FIG. 5 illustrates that the rotation torque has such a load torque waveform that a specific value suitable for display is changed between the average torque and the peak torque depending on a purpose.

Note that, when the relationship between the position of the seating part 56 for the exerciser and the center of the pedal mounting shaft 14 differs from that of FIG. 5, an absolute position of the top dead center 0° illustrated in FIG. 5 is a position closest to the exerciser's greater trochanter 55.

Figure 6:
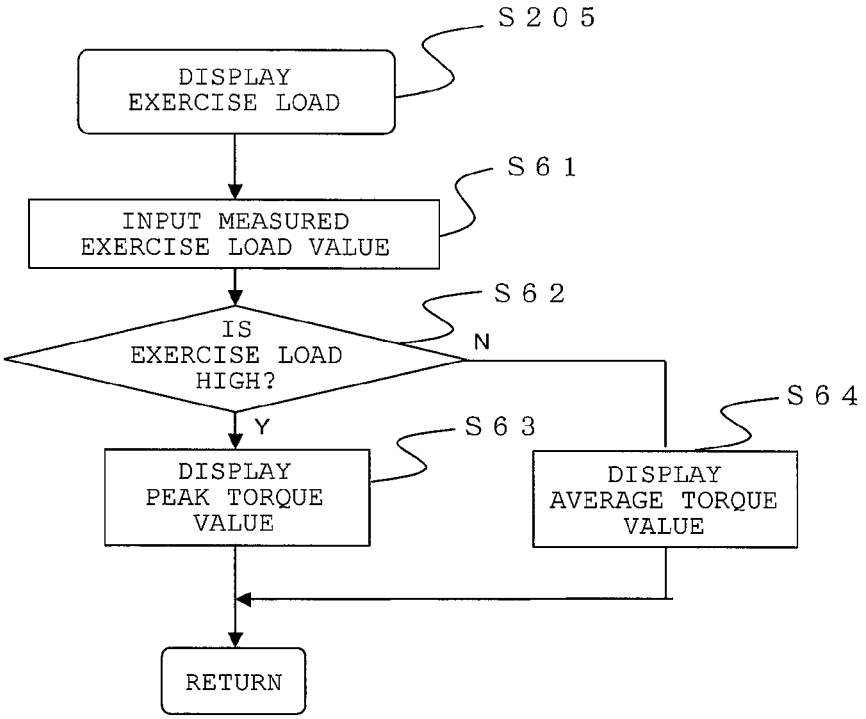
FIG. 6 is a flow chart illustrating a method of switching a torque to be displayed on the display device of the exercise therapy device between a peak torque and an average torque depending on a purpose according to the first embodiment of the present invention.

FIG. 6 is a flow chart illustrating a method of switching the torque to be displayed on the display device 8 of the exercise therapy device 1 between the peak torque and the average torque depending on a purpose according to the first embodiment of the present invention. FIG. 6 relates specifically to details of the processing of Step S205 of FIG. 2 for displaying the exercise load.

In Step S61, the control part 7 of the man-machine interface unit 2 inputs the measured exercise load value for the exercise currently executed, and in Step S62, the control part 7 determines whether or not the measured exercise load value is a high load intensity. Then, when it is determined in Step S62 that the measured exercise load value is a high load intensity, in Step 63, the control part 7 performs processing of sampling and displaying the peak torque. On the other hand, when it is determined in Step S62 that the measured exercise load value is a low load intensity, in Step S64, the control part 7 performs processing of sampling and displaying the average torque.

Figure 7:
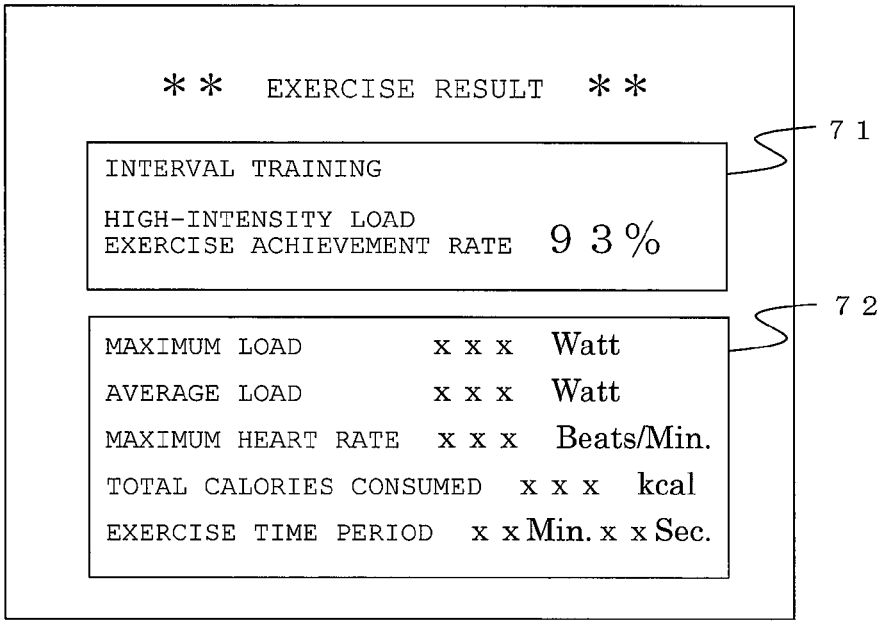
FIG. 7 illustrates an example of an indication of an achievement rate of a high-intensity exercise, which is displayed on the display device of the exercise therapy device according to the first embodiment of the present invention.

FIG. 7 illustrates an example of an indication of an achievement rate of the high-intensity exercise, which is displayed on the display device 8 of the exercise therapy device 1 according to the first embodiment of the present invention. The following expression can be given as an example of an expression for calculating the achievement rate of the interval training.

$$\text{(Achievement rate)}=\Sigma\text{(actual period of time for high-intensity exercise)}/\Sigma\text{(period of time for high-intensity exercise on exercise program)}\times 100\%$$

The control part 7 uses the expression given above to calculate the achievement rate, and displays the calculation result on the display device 8 as an interval training achievement rate indication 71. In FIG. 7, the interval training achievement rate indication 71 is displayed on the same screen as a screen for displaying another exercise result indication 72 such as total calories consumed, which is displayed on the related-art exercise therapy device.

As described above, in the first embodiment, the exercise therapy device, which is to be used to carry out the interval training in which the high-intensity exercise and the low-intensity exercise are alternately carried out, is configured to set the exercise load and exercise time period of the high-intensity exercise and low-intensity exercise as the exercise program. The exercise therapy device is further configured to display the temporal change of the exercise program on the display device of the exercise therapy device during the interval training.

As a result, the interval training can be controlled so that the high-intensity exercise is the anaerobic exercise and the low-intensity exercise is the aerobic exercise, and further, the exerciser can carry out training with the exercise load that suits his/her purpose while checking the next change of the exercise load.

Further, the exercise corresponding to an area for an allowable anaerobic exercise can be carried out as prescribed in the exercise prescription more accurately, and hence an appropriate exercise with little variation of the exercise therapy effect can be realized.

Further, even in a case of an exercise program including the aerobic exercise with a high-intensity load and the aerobic exercise with a low-intensity load, the exercise whose exercise time period is as prescribed in the exercise prescription can be carried out, and hence an appropriate exercise with little variation of the exercise therapy effect can be similarly realized.

Further, in regards to the numerical values or graph values to be displayed, when the exercise load state during execution of the exercise fluctuates every time the pedal is rotated or every time the leg is extended owing to the muscular strength exerted by the exerciser at his/her discretion, the peak torque value within one rotation is displayed without fail at the time of the interval training intended for the anaerobic exercise. As a result, it is possible to carry out the exercise while recognizing a ratio of the exercise load to the 1 RM, and it also is possible to realize the exercise prescription made by setting the exercise load with the 1 RM as the reference.

Further, the peak torque calculated for every rotation or every leg extension is displayed only in a high-intensity exercise area of the exercise program, and the average torque calculated for every rotation or every leg extension is displayed in a low-intensity exercise area, and hence appropriate load information can be obtained in each of the anaerobic exercise area and the aerobic exercise area.

Further, the exercise therapy device 1 has the function of comparing a time ratio of each of the high-intensity exercise and the low-intensity exercise, which is obtained as a result of actually carrying out the interval training, with a time ratio of each of the high-intensity exercise and the low-intensity exercise defined in the exercise program and displaying the achievement rate, which indicates how accurately each of the high-intensity exercise and the low-intensity exercise can be carried out. As a result, it is possible to recognize the achievement rate in execution of each of the high-intensity exercise and the low-intensity exercise, and evaluate whether the exercise actually carried out is excessive or insufficient with respect to the exercise prescription and reaction characteristics of the exerciser. Further, the exercise prescription is likely to be improved based on this information so that the exercise prescription is more suited to the exerciser in question.

Note that, in the display example of FIG. 4, the current load intensity and the past load intensity are indicated with the solid line and the dot line, but it should be understood that the type and thickness of the line are not limited thereto, and further, the color of the line is not limited to black and any color may be used as long as similar effects can be obtained. Further, the current time is arranged at the center of the time axis of FIG. 4, but the present invention is not limited thereto.

Further, in FIG. 4, the marker indicating the current time may be moved on the graph display or the graph display may be scrolled so that the current time on the graph is displayed at the marker.

Further, in the display example of FIG. 7, the achievement rate is displayed in percentage, but another unit may be used as long as the rate can be recognized and there is no need to enclose the achievement rate in rectangle as a display method. Further, what is displayed in the screen of FIG. 7 is not limited to the items given in this embodiment, and in regards to items other than the achievement rate, items that are not given in this embodiment may be displayed as long as similar effects can be obtained.

Further, in the present invention, the load intensity and the exercise time period are communicated to the exerciser with the screen display, but the following method can be adopted as a method of communicating the information to a visually-challenged exerciser. Specifically, for example, a change of the exercise load, a remaining exercise time period, and an advance notice of the change of the exercise intensity may be communicated to the visually-challenged exerciser with a change of a sound intensity, a change of a sound pitch, and an alarm sound, respectively, by outputting the sound from a speaker or headphones. Alternatively, instead of the sound, a device capable of bone conduction may be mounted so that a similar method can be carried out.

Further, in the invention described above, the exercise therapy device such as an ergometer whose pedals are operated by the exerciser to carry out the interval training is assumed, but the present invention is not limited thereto. The present invention is applicable to, for example, the exercise therapy device such as a treadmill.

Second Embodiment

Figure 8:
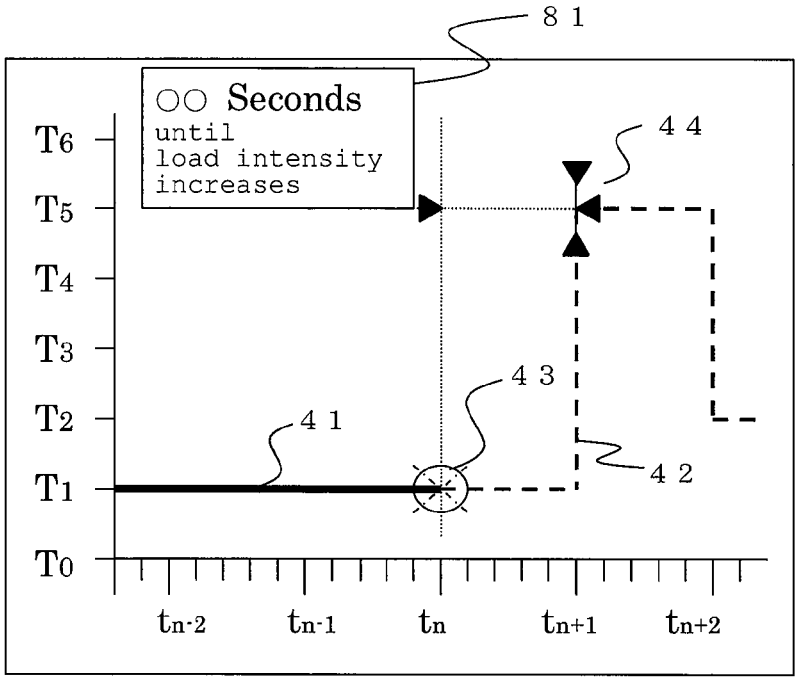
FIG. 8 illustrates an example of an indication of a period of time remaining until the exercise load is changed, which is displayed on the display device of the exercise therapy device according to a second embodiment of the present invention.

FIG. 8 illustrates an example of an indication of a period of time remaining until the exercise load is changed, which is displayed on the display device 8 of the exercise therapy device 1 according to a second embodiment of the present invention. In FIG. 8, a display effect is added to the screen of FIG. 4, which is displayed in the processing of Step S33 of FIG. 3 in the first embodiment described above. Specifically, a remaining time indication 81 for indicating a period of time remaining until the exercise load is changed is added as an item to be displayed, and the screen of FIG. 8 is made more visually recognizable than in FIG. 4.

Figure 9:
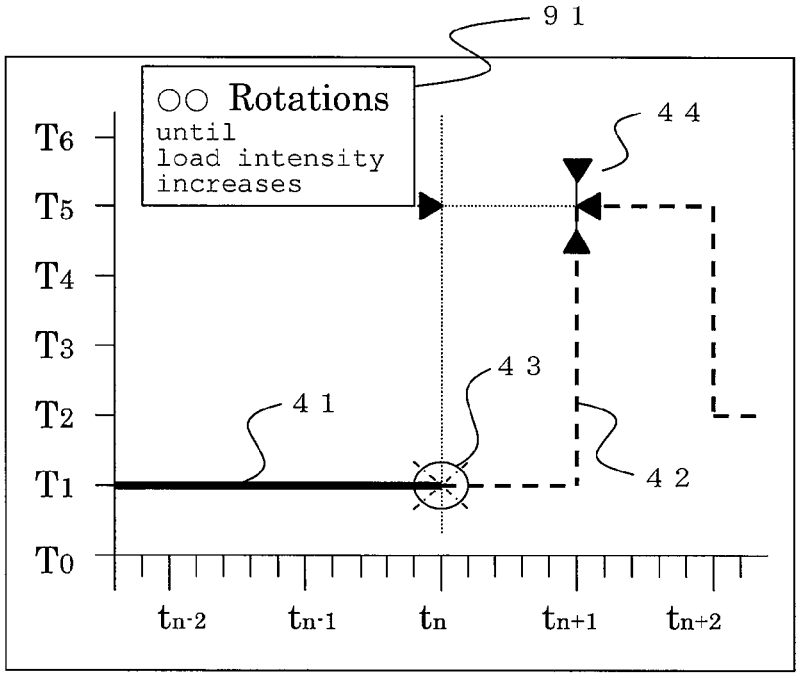
FIG. 9 illustrates an example of an indication of the number of rotations remaining until the exercise load is changed, which is displayed on the display device of the exercise therapy device according to the second embodiment of the present invention.

FIG. 9 illustrates an example of an indication of the number of rotations remaining until the exercise load is changed, which is displayed on the display device 8 of the exercise therapy device 1 according to the second embodiment of the present invention. In FIG. 9, a display effect is added to the screen of FIG. 4, which is displayed in the processing of Step S33 of FIG. 3 in the first embodiment described above. Specifically, a remaining rotation indication 91 for indicating the number of rotations remaining until the exercise load is changed is added as an item to be displayed, and the screen of FIG. 9 is made more visually recognizable than in FIG. 4.

Figure 10:
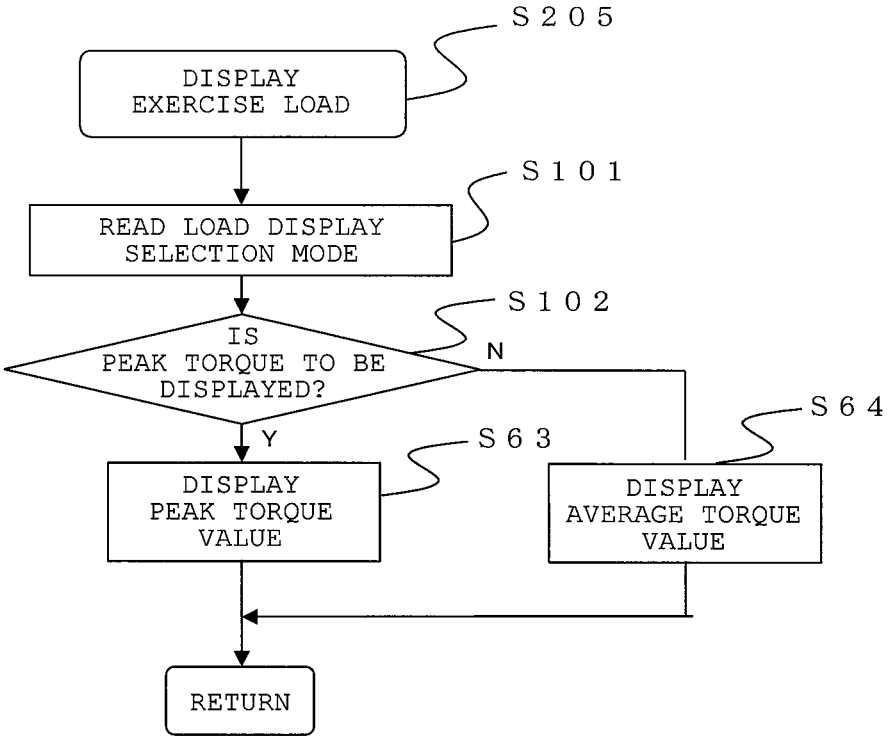
FIG. 10 is a flow chart illustrating a method of switching the torque to be displayed on the display device of the exercise therapy device between the peak torque and the average torque depending on a purpose according to the second embodiment of the present invention.

FIG. 10 is a flow chart illustrating a method of switching the torque to be displayed on the display device 8 of the exercise therapy device 1 between the peak torque and the average torque depending on a purpose according to the second embodiment of the present invention. FIG. 10 relates specifically to details of the processing of Step S205 of FIG. 2 for displaying the exercise load in the first embodiment described above.

In Step S101, the control part 7 of the man-machine interface unit 2 reads a set value, which defines in advance which of the peak torque and the average torque is to be displayed on the display device 8. Then, in Step S102, the control part 7 determines which of the peak torque and the average torque is to be displayed. When it is determined in Step S102 that the set value indicates a peak torque display mode, in Step S63, the control part 7 performs processing of sampling and displaying the peak torque even when the current exercise load is low. On the other hand, when it is determined in Step S62 that the set value indicates an average torque display mode, in Step S64, the control part 7 performs processing of sampling and displaying the average torque even when the current exercise load is high.

Note that, the indication of FIG. 8 or 9 may be displayed in any form as long as the period of time or number of rotations remaining from the current time until the exercise load is changed can be recognized, and the present invention is not limited to this display example as long as similar effects can be obtained.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An exercise therapy device, the exercise therapy device configured to be used by an exerciser to carry out interval training in which a high-intensity exercise corresponding to an anaerobic exercise and a low-intensity exercise corresponding to an aerobic exercise, which have different exercise loads, are alternately carried out, the exercise therapy device comprising:

a storage part in which an exercise program including set values of exercise loads and exercise time periods for the high-intensity exercise and the low-intensity exercise is stored;

a man-machine interface unit used by the exerciser and configured for selecting and setting the exercise program and displaying the exercise load proceeding along with a temporal change during the interval training;

a load control unit configured for controlling an exercise load to be applied to the exerciser according to the exercise program;

a load motor to be controlled by the load control unit to generate the exercise load;

a speed reduction mechanism for transmitting the exercise load generated by the load motor to the exerciser's feet as an appropriate load torque and rotation speed; and two pedals coupled to the speed reduction mechanism so as to be freely rotatable and used by the exerciser, wherein the man-machine interface unit comprises:

a display control part configured for looking ahead to a time at which exercise intensity of the exercise program is to change next during the interval training in accordance with a descriptive content of the exercise program and displaying the exercise program graphically as the exercise load proceeding along with a temporal change on a display device of the exercise therapy device, the exercise program displayed graphically having a time axis as an abscissa axis including a past, present, and future time, and an exercise load axis as an ordinate axis, so that an exerciser is capable of carrying out training with the exercise load suited to a purpose while checking a next change of the exercise load, and displaying an exercise-finished portion that corresponds to a transition of the exercise load in the past time and a result of looking ahead that corresponds to a transition of the exercise load in the future time graphically using different lines.

2. The exercise therapy device according to claim 1, wherein the display control part displays the exercise program on the display device in a graph, and performs one of moving a marker indicating a current time on the displayed graph and scrolling the displayed graph so that a current time on the graph is displayed at the marker.

3. The exercise therapy device according to claim 1, wherein the display control part displays a period of time remaining until the exercise load is changed next on the display device.

4. The exercise therapy device according to claim 1, wherein when the interval training is finished, the display control part displays a ratio between a time ratio of the high-intensity exercise actually carried out by the exerciser and a time ratio of the high-intensity exercise on the exercise program on the display device as an achievement rate.

5. The exercise therapy device according to claim 1, wherein:

the pedals are operated by the exerciser to carry out the interval training; and the display control part is configured to switch displaying between a temporal change of an average torque, which is an average value of rotation torques in one rotation of pedaling of the exerciser, and a temporal change of a peak torque, which is a maximum value of the rotation torques.

6. The exercise therapy device according to claim 5, wherein the display control part displays the peak torque on the display device during a period in which the interval training is the high-intensity exercise, and displays the average torque on the display device during a period in which the interval training is the low-intensity exercise.

7. A control method for an exercise therapy device executed by the man-machine interface unit in a control apparatus for the exercise therapy device according to claim 1, the control method comprising:

storing an exercise load and exercise time period for the high-intensity exercise and low-intensity exercise in a storage part of the exercise therapy device as an exercise program, input by the exerciser via an input device of the exercise therapy device; and looking ahead to a time at which exercise intensity of the exercise program is to change next during the interval training in accordance with a descriptive content of the exercise program and displaying the exercise program graphically as the exercise load proceeding along with a temporal change on a display device of the exercise therapy device, the exercise program displayed graphically having a time axis as an abscissa axis including the past, present, and future time, and an exercise load axis as an ordinate axis, so that the exerciser is capable of carrying out training with the exercise load suited to a purpose while checking a next change of the exercise load, and displaying an exercise-finished portion corresponding to a transition of the exercise load in the past time and the result of looking ahead corresponding to a transition of the exercise load in the future time graphically using different lines.

* * * * *